US007887213B2

(12) United States Patent
Hubbs

(10) Patent No.: US 7,887,213 B2
(45) Date of Patent: Feb. 15, 2011

(54) WINDOW LIGHT BOX WITH BLIND

(76) Inventor: Irma Hubbs, 1068 Kingswood Way, Port Orange, FL (US) 32129

( * ) Notice: Subject to any disclaimer, the term of this patent is extended or adjusted under 35 U.S.C. 154(b) by 0 days.

(21) Appl. No.: 12/386,063

(22) Filed: Apr. 14, 2009

(65) Prior Publication Data

US 2010/0259915 A1 Oct. 14, 2010

(51) Int. Cl.
*A47F 11/10* (2006.01)

(52) U.S. Cl. ..... 362/125; 362/97.1; 362/145; 362/147; 362/253; 362/806

(58) Field of Classification Search ..... 362/97.1, 362/125, 127, 145, 147, 253, 806, 812; 40/541, 40/545, 564, 574
See application file for complete search history.

(56) References Cited

U.S. PATENT DOCUMENTS

| | | | | |
|---|---|---|---|---|
| 4,864,475 | A | 9/1989 | Jung | |
| 5,191,748 | A | 3/1993 | Baughman | |
| 5,426,879 | A * | 6/1995 | Hecker | 40/427 |
| 5,437,323 | A | 8/1995 | Holden | |
| 5,457,905 | A | 10/1995 | Kaplan | |
| 5,461,397 | A | 10/1995 | Zhang et al. | |
| 5,573,328 | A | 11/1996 | Hwang | |
| 5,778,958 | A | 7/1998 | Stebner | |
| 5,966,856 | A | 10/1999 | Alu | |
| 6,014,829 | A | 1/2000 | Wilson et al. | |
| 6,019,481 | A | 2/2000 | Ambach et al. | |
| 6,814,468 | B2 | 11/2004 | Lai et al. | |
| 7,181,783 | B2 | 2/2007 | O'Reilly | |
| D554,795 | S | 11/2007 | Beeson | |
| 2002/0144441 | A1 | 10/2002 | Zentmire et al. | |
| 2003/0029918 | A1 | 2/2003 | Leanheart et al. | |
| 2008/0192456 | A1 | 8/2008 | Van Tertholen et al. | |

* cited by examiner

*Primary Examiner*—Sandra L O Shea
*Assistant Examiner*—Meghan K Dunwiddie
(74) *Attorney, Agent, or Firm*—Paul S. Rooy PA

(57) ABSTRACT

A window light box with blind. A light source within the light box provides light through a front aperture. A blind is mounted to a light box front, and is extendable over the front aperture. The blind and/or light source may be colored; the blind may be opaque, translucent, or transparent. The light source is electrically connected to a power source through a switch, which may be an ON/OFF dimmer switch. An alternate embodiment is disclosed wherein the light source is electrically connected to a power source through a switching receiver, and a remote controls the receiver. A battery back-up is disclosed to power the light source in the event of power source interruption. The light source may be fluorescent, incandescent, serpentine lighting, a Christmas light string, LED, or other appropriate light source.

17 Claims, 5 Drawing Sheets

WINDOW LIGHT BOX WITH BLIND

BACKGROUND OF THE INVENTION

1. Field of the Invention

This invention relates indoor lights and wall adornments, and in particular to a window light box with blind.

2. Background of the Invention

An on-going problem associated with rooms which have no windows through which to admit natural light, is the darkness and closed-in claustrophobic feelings such rooms can create in people within such rooms. These types of rooms preponderate in hospitals, schools, prisons, offices, submarines, cabins, hotels, industrial plants—in short, any interior room lacking a window giving out into the exterior.

The problem is exacerbated where individuals within such rooms have sensitive eyes, and conventional fluorescent lights would irritate such individuals. It would be desirable in these cases to provide a source of light which is aesthetic and yet subdued, and which lends a warm "homey" atmosphere to the room. Such a light would also be useful in "blackout" situations, such as in war, where the windows of a structure are intentionally masked off, creating rooms with no natural external light source.

Existing Designs

A number of approaches have been hazarded towards achieving the objective of providing a warm, attractive window light box. U.S. Pat. No. 4,864,475 was granted Jung, and U.S. Pat. No. 6,014,829 was granted to Wilson et al., for light boxes which house light sources within a box-like structure, and the lights are covered by a species of lens. Similarly, Van Tertholen et al. Pub. No. 2008/0192456 taught a light box shaped like an artificial window. While these disclosures taught light sources in boxes, they did not provide a blind to cover the light source, in order to achieve a warm, homey look.

Several inventions taught back-lit signs. For example, U.S. Pat. Nos. 5,191,748, 5,966,856 and 5,457,905 were granted Baughman, Alu and Kaplan respectively. While these patents disclosed signs which were easily visible due to their rear illumination, they did not teach a warm source of light for windowless rooms.

SUMMARY OF THE INVENTION

Accordingly, it is an object of the present invention to provide a window light box with blind which provides a warm, homey light to a room without windows. Design features allowing this object to be accomplished include a window light box having an interior light source shining through a front aperture, and a blind covering the front aperture. Advantages associated with the accomplishment of this object include increased aesthetic appeal, a more cheerful ambiance, and softer light quality.

It is another object of the present invention to provide a window light box with blind which is capable of providing a variety of lighting effects. Design features allowing this object to be accomplished include different types and colors of light sources, different degrees of blind transparency, and different colors of blinds. A benefit associated with the accomplishment of this object is achieving a variety of lighting effects in order to customize the type and quality of light emitted by the window light box with blind to individual taste.

It is still another object of this invention to provide a window light box with blind which will function even if power to the window light box with blind is interrupted. Design features enabling the accomplishment of this object include a battery electrically connected to a power source and a light source. Advantages associated with the realization of this object include increased window light box with blind reliability and transportability.

It is another object of the present invention to provide a window light box with blind which can be turned on and off, dimmed, and brightened from a location remote from the window light box with blind. Design features allowing this object to be accomplished include a remote control in communication with a receiver, which controls a light source. A benefit associated with the accomplishment of this object is convenience of use.

It is still another object of this invention to provide a window light box with blind which is easy to clean. Design features enabling the accomplishment of this object include a retractable front -mounted blind, and a large front aperture through which to reach. Advantages associated with the realization of this object include increased sanitation and convenience.

It is yet another object of this invention to provide a window light box with blind which is inexpensive to manufacture. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIG. 2. Sheet three contains FIG. 3. Sheet four contains FIG. 4. Sheet five contains FIG. 5.

DETAILED DESCRIPTION OF THE PREFERRED EMBODIMENT

Figure 1:
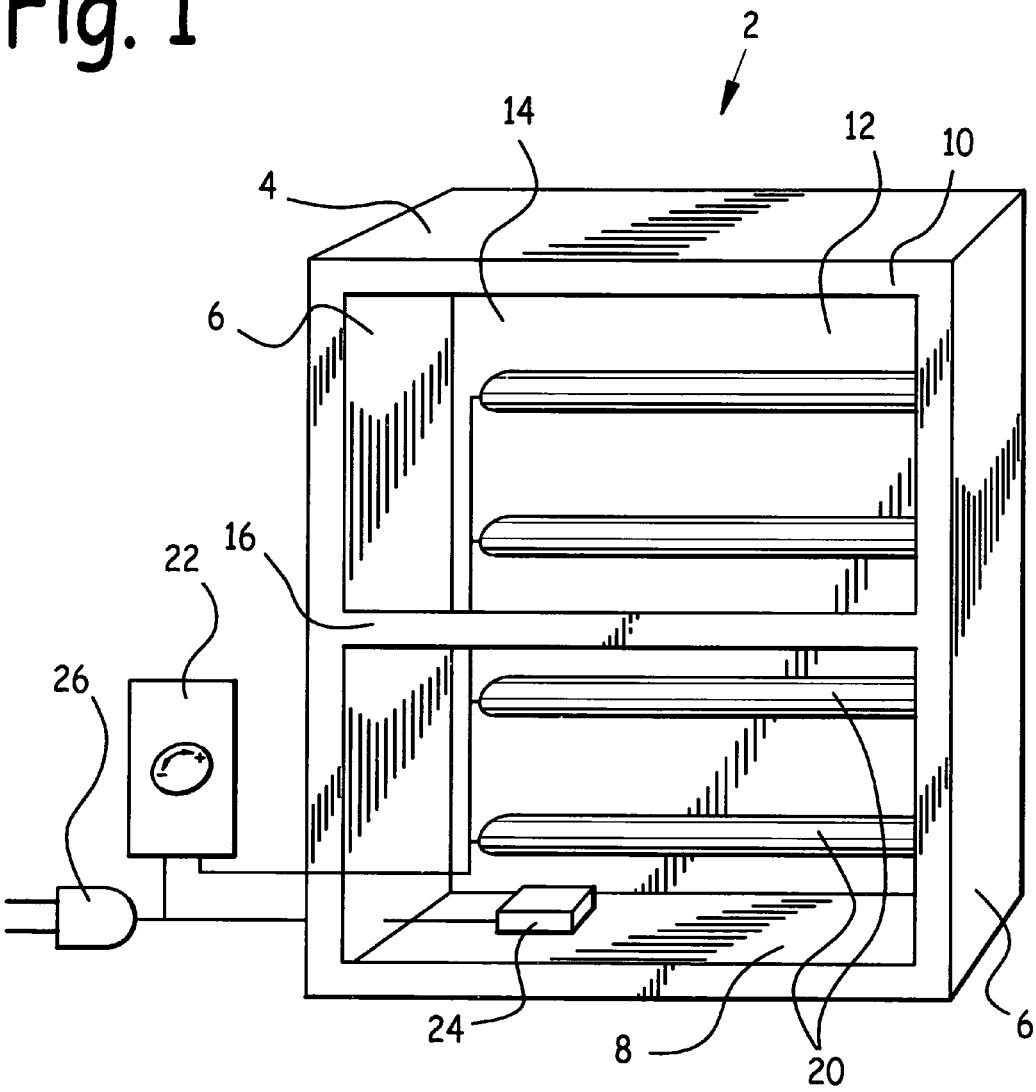
FIG. 1 is a front isometric view of a window light box, without a blind installed.
Figure 2:
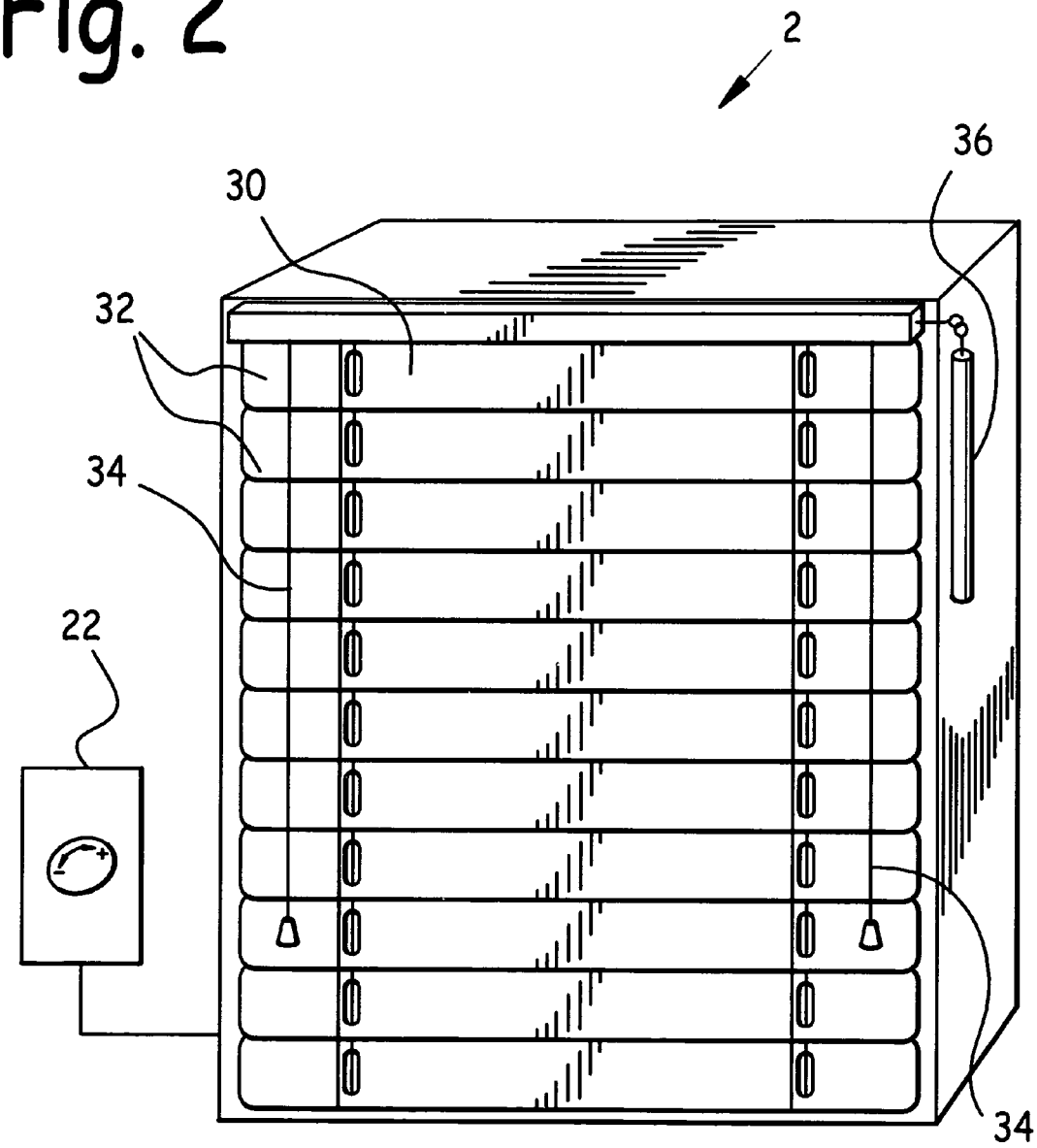
FIG. 2 is a front isometric view of a window light box, with blind installed.

Referring now to FIGS. 1 and 2 we observe a front isometric view of window light box 2. In FIG. 1 window light box 2 has no blind 30 installed; in FIG. 2 blind 30 has been installed to the front of window light box 2.

Window light box 2 is of substantially rectangular prismatic shape having back 14; top 4, sides 6 and floor 8 rigidly attached along the edges of back 14 substantially perpendicular to back 14, and front 10 attached to sides of top 4, sides 6 and floor 8 opposite back 14. Front 10 comprises front aperture 12 through which an interior of window box light 2 communicates with an exterior of window light box 2. Window light box 2 may further comprise one or more cross-pieces 16 extending across front aperture 12 for re-enforcement and aesthetic purposes.

Light source 20 is disposed within an interior of window light box 2. In the embodiment depicted in FIG. 1, light source 20 was a plurality of fluorescent light bulbs. Light source 20 is connected to power source 26 through switch 22. In the embodiment depicted in FIG. 1, switch 22 was a push ON/OFF rotary dimmer, and power source 26 was a wall plug, although it is intended to fall within the scope of this embodiment that window light box 2 be hard-wired into a building's electrical system, and that switch 22 be any appropriate switch.

Window light box 2 may further comprise back-up battery 24 electrically connected to power source 26, and light source 20 through switch 22. In this embodiment, battery 24 constantly charges whenever window light box 2 is electrically connected to power source 26. In the eventuality that power source 26 is interrupted (as in the case of a power interruption or failure), battery 24 can provide electrical power to light source 20 through switch 22.

In the preferred embodiment, power source 26 was conventional house current, e.g. 110 or 220 volts, and battery 24 comprised a trickle charger and any necessary electrical components to receive charge from power source 26, and provide electricity to light source 20 through switch 22. Because such charging/power electrical installation is old and well-known in the art, it is not depicted in the instant drawings, but rather collectively referred to as battery 24.

The window light box 2 in FIG. 2 incorporates extendable blind 30 mounted to front 10 in such a position so that blind 30, when extended, covers front aperture 12. Thus, when light source 20 is illuminated and blind 30 covers front aperture 12, window light box 2 may give the appearance of a window covered by blind 30, with exterior sun light shining through blind 30.

Blind 30 may be opaque, translucent to varying degrees, or transparent. Blind 30 may be any color desired. In addition, light source 20 may be any color desired. For example, a warm yellow light source 20 shining through a mildly translucent blind 30 may give the appearance of a rising or setting sun shining through a window partially obscured by blind 30.

In the preferred embodiment, blind 30 was a conventional Venetian blind having a plurality of horizontally-disposed slats 32. Draw strings 34 serve to raise and lower blind 30, and angle adjuster 36 sets the angles of slats 32 to window light box front 10. It is intended to fall within the scope of this embodiment, however, that blind 30 be any appropriate blind, including but not limited to vertical blinds, Japanese folding paper blinds, roll-up window shade, etc.

Figure 3:
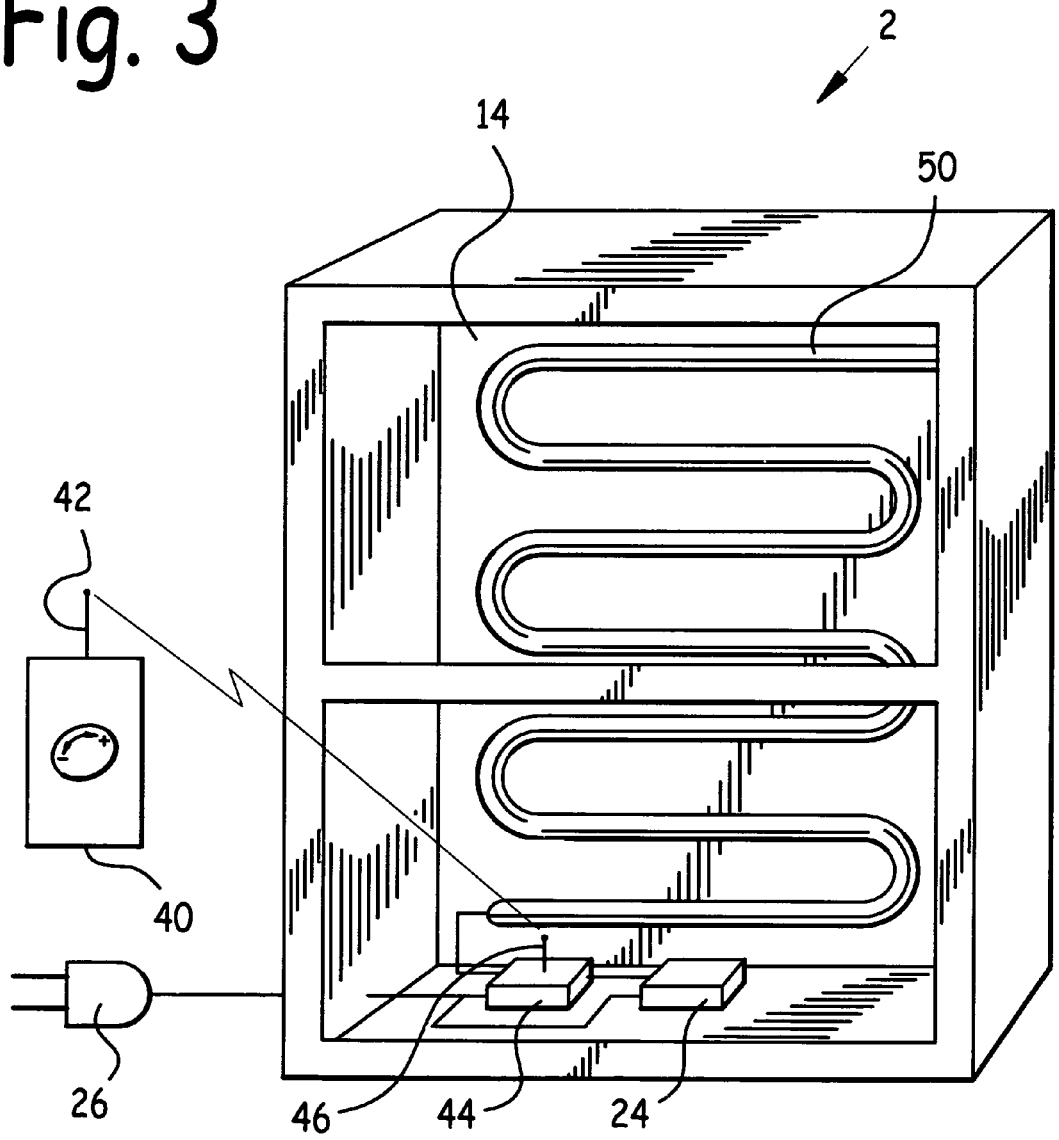
FIG. 3 is a front isometric view of a window light box having a serpentine light and remote control, without a blind installed.

FIG. 3 is a front isometric view of window light box 2 having a serpentine light 50 and remote control 40, without a blind 30 yet installed.

FIG. 3 depicts a window light box 2 embodiment wherein light source 20 is a serpentine light 50, also sometimes referred to as a "tube light". In this embodiment, serpentine light 50 is mounted within the interior of window light box 2 on back 14, and is electrically connected to power source 26 through receiver 44.

Remote control 40 is a remote switch which commands receiver 44 to turn light source 20 (which is serpentine light 50 in this embodiment) ON and OFF, and also to dim or brighten light source 20. Remote control 40 may comprise remote control antenna 42, and receiver 44 may comprise receiver antenna 46, in order to facilitate communication between remote control 40 and receiver 44. Remote control 40 and receiver 44 may rely on any of a number of existent technologies for communication, including but not limited to infrared, blue tooth, FM, etc.

As in the embodiment window light box 2 depicted in FIG. 1, the embodiment window light box 2 depicted in FIG. 3 may incorporate a back-up battery 24 to power light source 20 in case of failure or unavailability of power source 26. Battery 24 is electrically connected to light source 20 through receiver 44, and to power source 26 whenever such is available. Thus battery 24 trickle-charges from power source 26 when power source 26 is available, and can provide electrical power to light source 20, switched through receiver 44, when power source 26 is not available.

While FIG. 1 illustrates a light source 20 which comprises fluorescent light(s), and FIG. 3 illustrates a light source 20 which is serpentine light 50, it is intended to fall within the scope of this disclosure that any appropriate light source 20 be used, including but not limited to fluorescent lights, serpentine or tube lights, Christmas tree lights, incandescent lights, light emitting diodes (LEDs), etc.

Figure 4:
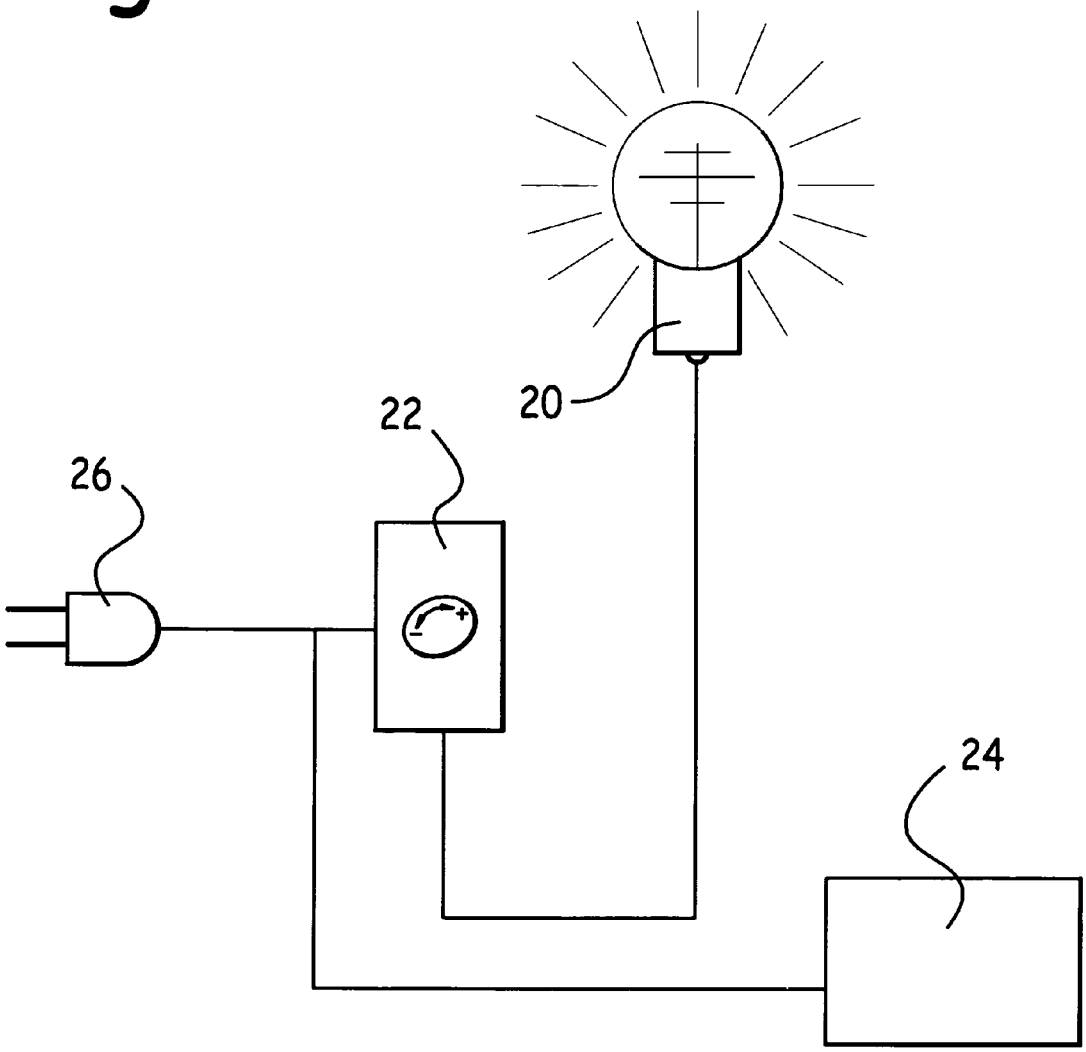
FIG. 4 is an electrical schematic of a window light box having a back-up battery installed.

FIG. 4 is an electrical schematic of a window light box 2 having a back-up battery 24 installed. As may be observed in this figure, light source 20 is electrically connected to power source 26 through switch 22. Switch 22 may be an ON/OFF rotary dimmer, whereby light source 20 may be turned ON and OFF, and dimmed and brightened, according to the desires of an individual being illuminated by window light box 2.

Battery 24 is also electrically connected to power source 26. Thus, when power source 26 is supplying electricity, battery 24 is constantly charging. If power source 26 were to fail or be disconnected, then battery 24 can supply electrical energy to light source 20 through switch 22.

Figure 5:
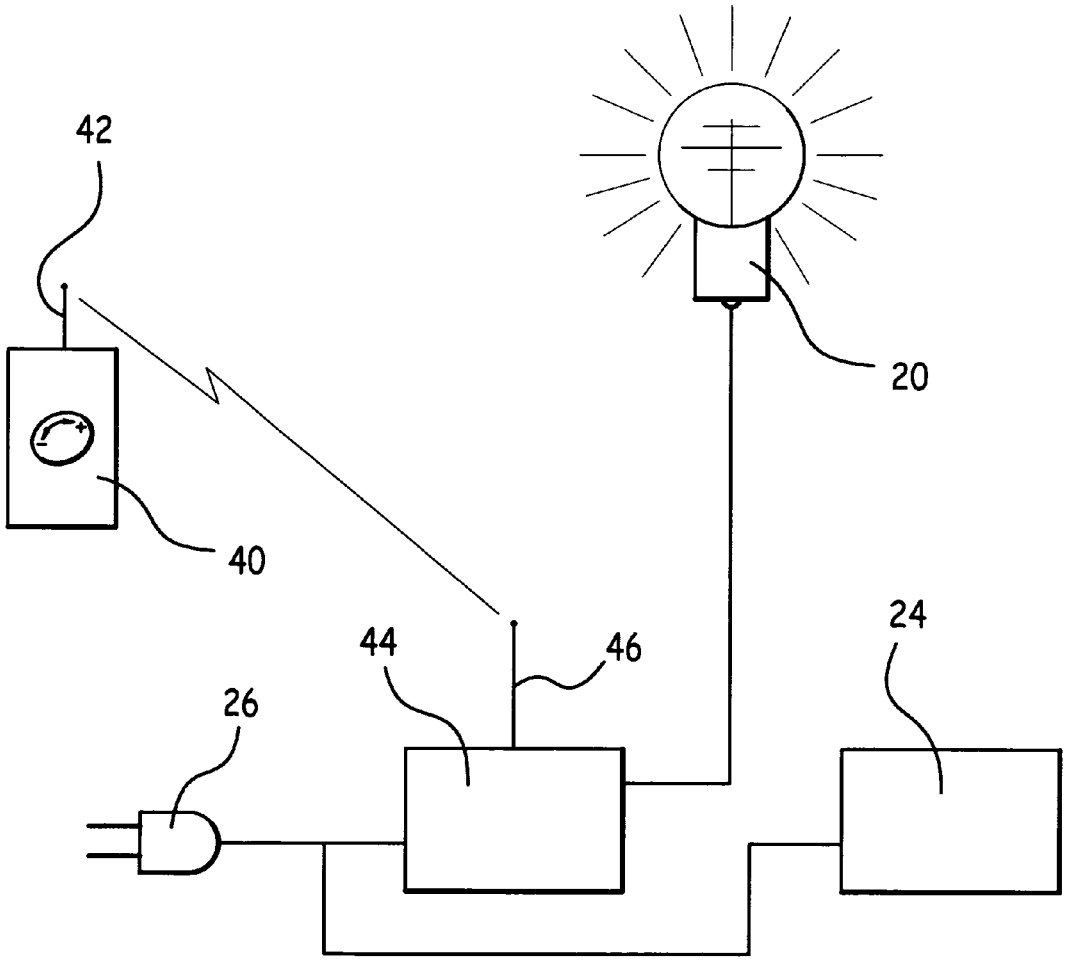
FIG. 5 as an electrical schematic of a window light box with a back-up battery and remote control.

FIG. 5 as an electrical schematic of a window light box 2 with a back-up battery 24, remote control 40, and receiver 44. As may be observed in this figure, remote control 40 is a remote switch which commands receiver 44 to turn light source 20 ON and OFF, and also to dim or brighten light source 20. Remote control 40 may comprise remote control antenna 42, and receiver 44 may comprise receiver antenna 46, in order to facilitate communication between remote control 40 and receiver 44. Remote control 40 and receiver 44 may rely on any of a number of existent technologies for communication, including but not limited to infrared, blue tooth, FM, etc.

In the preferred embodiment, window light box 2 was manufactured of wood, plastic, aluminum, metal, synthetic, or any other appropriate material. Light source 20, switch 22, and the wiring connections were conventional, commercially available off-the-shelf materials. Battery 24, remote control 40, and receiver 44 were made of commercially available off-the-shelf materials. Blind 30 was a commercially available blind such as a Venetian blind, vertical blind, or any other appropriate blind.

While a preferred embodiment of the invention has been illustrated herein, it is to be understood that changes and variations may be made by those skilled in the art without departing from the spirit of the appending claims.

DRAWING ITEM INDEX

2 window light box
4 top
6 side
8 floor
10 front
12 front aperture
14 back
16 cross-piece
20 light source
22 switch
24 battery
26 power source

30 blind
32 slat
34 draw string
36 angle adjuster
40 remote control
42 remote control antenna
44 receiver
46 receiver antenna
50 serpentine light

I claim:

1. A window light box comprising a back, a front, a front aperture in said front, a light source inside said window light box, a blind attached to said front extendable over said front aperture, a power source electrically connected to said light source through a receiver, said receiver comprising switching means to connect or disconnect said light source from said power source, and a remote control capable of communicating with said receiver and capable of commanding said receiver to connect or disconnect said light source from said power source.

2. The window light box of claim 1 further comprising a back-up battery electrically connected to said power source, and electrically connected to said light source through said receiver, whereby said battery may supply electrical power to said light source through switching in said receiver if said power source is interrupted.

3. The window light box of claim 2 wherein said receiver comprises means of dimming and brightening said light source, and wherein said remote control is capable of instructing said receiver to dim and brighten said light source.

4. The window light box of claim 3 wherein said remote control and said receiver communicate via infrared.

5. The window light box of claim 3 wherein said remote control comprises a remote control antenna, and wherein said receiver comprises a receiver antenna, whereby communication between said remote control and said receiver is facilitated.

6. The window light box of claim 1 wherein said light source comprises at least one fluorescent light.

7. The window light box of claim 1 wherein said light source is a serpentine light attached to said back.

8. The window light box of claim 1 wherein said light source is a string of Christmas lights.

9. The window light box of claim 1 wherein said light is colored.

10. The window light box of claim 1 wherein said light source comprises light emitting diodes.

11. The window light box of claim 1 further comprising at least one cross-piece extending across said front aperture, each end of said cross-piece being rigidly attached to said front.

12. A window light box comprising a back; a front; a front aperture in said front; a top rigidly attached to a top edge of said back; a side attached to each side edge of said back; a floor attached to a bottom edge of said back; a light source inside said window light box attached to said back; a blind attached to said front extendable over said front aperture, said blind comprising a plurality of parallel slats; means of extending and retracting said blind over said front aperture; means of varying an angle between each said slat and said front; a power source electrically connected to said light source through a receiver, said receiver comprising switching means to connect or disconnect said light source from said power source; and a remote control capable of communicating with said receiver and capable of instructing said receiver to connect or disconnect said light source from said power source; said front being rigidly attached to edges of said top, sides and floor opposite said back.

13. The window light box of claim 12 further comprising a back-up battery electrically connected to said power source, and electrically connected to said light source through said receiver, whereby said battery may supply electrical power to said light source through switching in said receiver if said power source is interrupted.

14. A window light box comprising a back, a front, a front aperture in said front, a top rigidly attached to a top edge of said back, a side attached to each side edge of said back, a floor attached to a bottom edge of said back, a light source inside said window light box attached to said back, and a blind attached to said front extendable over said front aperture, said front being rigidly attached to edges of said top, sides and floor opposite said back, said blind being colored.

15. A window light box comprising a back, a front, a front aperture in said front, a top rigidly attached to a top edge of said back, a side attached to each side edge of said back, a floor attached to a bottom edge of said back, a light source inside said window light box attached to said back, and a blind attached to said front extendable over said front aperture, said front being rigidly attached to edges of said top, sides and floor opposite said back, said blind being translucent.

16. A window light box comprising a back, a front, a front aperture in said front, a top rigidly attached to a top edge of said back, a side attached to each side edge of said back, a floor attached to a bottom edge of said back, a light source inside said window light box attached to said back, and a blind attached to said front extendable over said front aperture, said front being rigidly attached to edges of said top, sides and floor opposite said back, said blind being transparent.

17. A window light box comprising a back, a front, a front aperture in said front, a top rigidly attached to a top edge of said back, a side attached to each side edge of said back, a floor attached to a bottom edge of said back, a light source inside said window light box attached to said back, and a blind attached to said front extendable over said front aperture, said front being rigidly attached to edges of said top, sides and floor opposite said back, said blind being opaque.

* * * * *

UNITED STATES PATENT AND TRADEMARK OFFICE

CERTIFICATE OF CORRECTION

PATENT NO. : 7,887,213 B2
APPLICATION NO. : 12/386063
DATED : February 15, 2011
INVENTOR(S) : Irma Hubbs It is certified that error appears in the above-identified patent and that said Letters Patent is hereby corrected as shown below:

Column 1 Line 65: Should be: Start new paragraph at column 1 line 65.

Signed and Sealed this
Twenty-eighth Day of June, 2011

David J. Kappos

David J. Kappos
*Director of the United States Patent and Trademark Office*